US006425588B1

(12) United States Patent
Holland

(10) Patent No.: US 6,425,588 B1
(45) Date of Patent: Jul. 30, 2002

(54) SAFETY BRAKE FOR IN-LINE SKATES

(75) Inventor: Ronald A. Holland, Newport Beach, CA (US)

(73) Assignee: Hemisphere Group, Inc., Irvine, CA (US)

( * ) Notice: Subject to any disclaimer, the term of this patent is extended or adjusted under 35 U.S.C. 154(b) by 0 days.

(21) Appl. No.: 09/302,542

(22) Filed: Apr. 30, 1999

(51) Int. Cl.[7] ..... A63C 17/14

(52) U.S. Cl. ..... 280/11.208; 280/11.211; 280/11.216; 280/11.221; 280/11.232

(58) Field of Search ..... 280/11.19, 11.2, 280/11.21, 11.22, 11.23; 188/5, 29

(56) References Cited

U.S. PATENT DOCUMENTS

| | | | | | |
|---|---|---|---|---|---|
| 4,817,974 | A | | 4/1989 | Bergeron | 280/11.2 |
| 5,135,244 | A | * | 8/1992 | Allison | 280/11.22 X |
| 5,192,099 | A | * | 3/1993 | Riutta | 280/11.22 X |
| 5,207,438 | A | * | 5/1993 | Landers | 188/5 X |
| 5,342,071 | A | * | 8/1994 | Soo | 280/11.2 X |
| 5,413,362 | A | * | 5/1995 | De Santis | 280/11.22 X |
| 5,462,295 | A | | 10/1995 | Seltzer | 280/11.19 |
| 5,465,984 | A | | 11/1995 | Pellegrini, Jr. et al. | 280/11.2 |
| 5,478,094 | A | * | 12/1995 | Pennestri | 280/11.22 X |
| 5,486,011 | A | * | 1/1996 | Nelson | 280/11.22 X |
| 5,527,048 | A | | 6/1996 | Conte | 280/112 |
| 5,527,049 | A | | 6/1996 | Ortiz | 280/11.2 |
| 5,551,712 | A | * | 9/1996 | Repucci | 188/29 X |
| 5,582,418 | A | * | 12/1996 | Closser | 280/11.2 X |
| 5,630,595 | A | | 5/1997 | Perner | 280/11.2 |
| 5,630,597 | A | * | 5/1997 | Klukos | 188/5 X |
| 5,685,550 | A | | 11/1997 | Mayer, II | 280/11.2 |
| 5,709,395 | A | | 1/1998 | Lee | 280/11.2 |
| 5,873,583 | A | * | 2/1999 | Moore | 280/11.22 X |

* cited by examiner

*Primary Examiner*—Lanna Mai
*Assistant Examiner*—Christopher Buchanan
(74) *Attorney, Agent, or Firm*—Cislo & Thomas LLP; David L. Hoffman, Esq.

(57) ABSTRACT

A braking system preferably for an in-line skate includes a brake pad mounted to a forward end of a skate frame and an elevated front wheel attached to the skate frame by two pivot arms. The pivot arms are biased forward which is in a clockwise direction with respect to their pivot point. When skating normally, the pivot arms bias the wheel against the brake pad, but the wheel is elevated from the skating surface and thus the brake is not engaged. When skating in a rearward direction, or desiring a push start, the skater rotates the toe portion of the skate downward and raises the heel. The front wheel will engage the skating surface and the reaction force on the wheel due to friction between it and the skating surface which will urge the wheel forward and increase the contact pressure between it and the brake pad. When skating forward, if the skater rotates his or her foot so that the front wheel engages the skating surface, the frictional force between the surface and the wheel causes a rearward force on the wheel away from the brake pad, thus ensuring that the skater will not trip due to sudden braking of the front wheel.

7 Claims, 3 Drawing Sheets

1
2
3
3a
8
9
10
4
6

B
12
P
3
16
3a
10
4
6
9

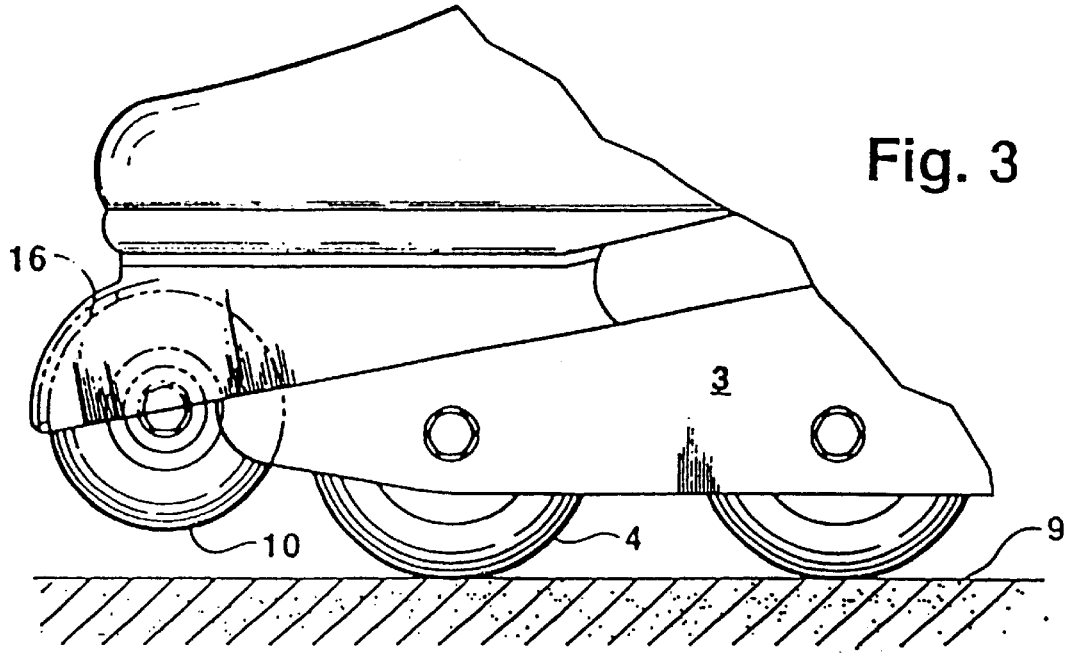
Fig. 3
Fig. 4
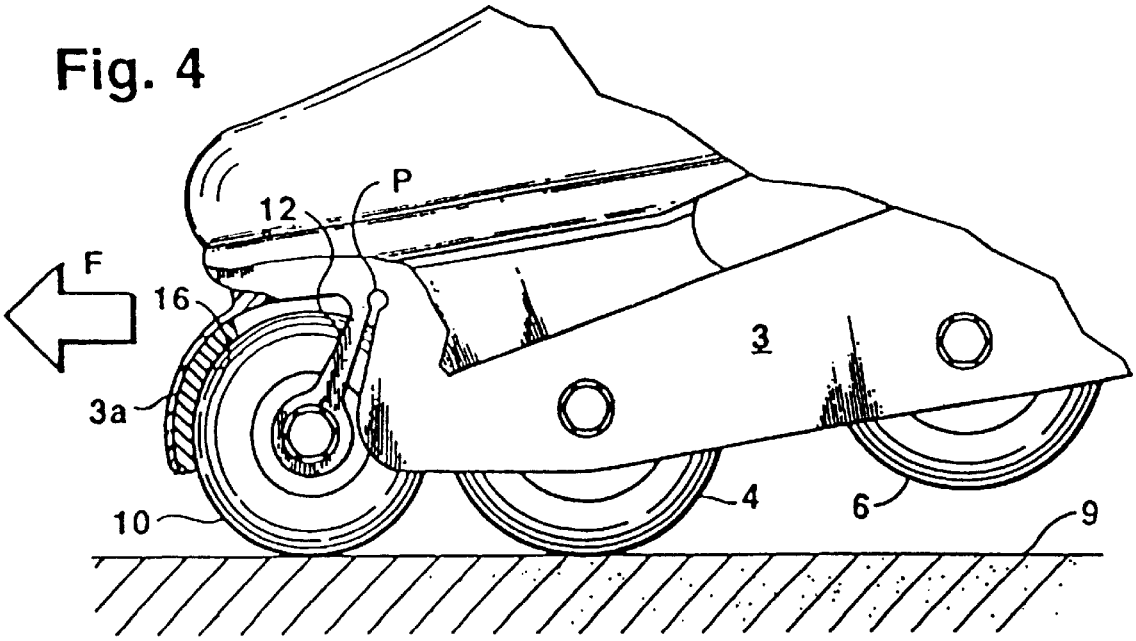

SAFETY BRAKE FOR IN-LINE SKATES

BACKGROUND OF TIME INVENTION

The present invention relates to a brake for in-line skates, and in particular, to a front brake which is difficult to unintentionally actuate yet provides a reliable braking force.

In-line skating has become increasingly popular. In many ways, it is similar to ice skating. Accordingly, playing hockey on in-line skates has also become popular. Standard in-line skates have a brake pad located at the heel of the skate. The brake is actuated by bending the knee of one leg and extending the other leg forward while rotating the toes upward and the heel downward as much as possible so that the brake will contact the ground. This is awkward for trying to stop or to hold one's ground against being pushed, or for obtaining a quick start. It is also awkward and potentially will trip the skater if used to stop while going backwards. While one can perform a T-stop, such a stop will damage the wheels and would be difficult to engage while moving backwards.

It is also useful to turn the skate sideways to get a push start, as in ice skating. However, a push start cannot be initiated with one's skates aligned. It is desirable to obtain a push start without turning the skate so that one can rapidly go from stopped to skating. It is also desirable to be able to stop safely while going backwards, and to be able to resist someone pushing the skater backwards. It is further desirable that such a brake be safe from causing the skater to trip over it when skating forwards. Such a brake would also be helpful in couples skating and for the novice skater.

Several attempts at brakes having some of these characteristics have been made. For example, U.S. Pat. No. 5,192,099 to Riutta discloses a braking system for use on the front or rear wheel of an in-line skate. The brake prevents reverse rotation of the wheel. Specifically, reverse rotation of the front wheel is prevented by a restraining member which is connected to the skate frame in the region above and behind the front wheel. The free end of the restraining member constantly bears against the front wheel and is equipped with teeth or serrations which frictionally engage the front wheel and which bite upon reverse rotation of the wheel. These teeth allow forward rotation of the front wheel. While this brake can provide a push start, the teeth can damage the wheel. In addition, although the teeth may not engage when the wheel is rotating forward, they can cause some drag on the wheel and may cause skidding and wheel damage. Furthermore, it is not possible to provide a controlled and variable braking force. Perhaps most importantly, this brake prevents reverse skating. Even if one could skate backwards somehow, when the brake is applied, it is abrupt and could cause skidding, damage to the wheel, and/or trip the skater.

A front wheel brake which is not activated during normal skating is shown in U.S. Pat. No. 5,486,011 to Nelson. The front wheel is spring-biased downward. There is a brake pad above it. There will be a braking force for forward or rearward skating by pressing down on the front wheel with sufficient force, whereupon the front wheel will contact the braking pad. The Nelson brake is activated by downward force only and thus has limited braking force for providing a push start or preventing rearward rotation. More importantly, when skating forward, if one tilted one's foot, the brake could catch and trip the skater.

What is needed is a one-way brake which is not activated during normal skating, which can be applied with a variable force, and which is not cumbersome to use yet provides a secure braking force.

SUMMARY OF THE INVENTION

In one embodiment, the invention provides a safety brake for an in-line type of skate or other roller skate. The front wheel of the skate is elevated with respect to the line formed by the skating surface of the other wheels. It is biased forward by attachment to the skate frame by an elongated arm. A braking pad is located on the frame to the front of the wheel such that the rest position of the wheel is against the brake pad. When skating normally, whether skating forwards or backwards, the front wheel will not contact the ground and thus the brake will not be actuated. If the skater happens to lean forward while skating forward, frictional reaction force will tend to push the wheel toward the back of the skate, thus deactivating or reducing the brake force. When the skater wants a push start, or wants to get in a set position such as for contact, the skater leans forward and pushes backward on the skate. The front wheel is pushed forward with respect to the skate and is securely engaged by the brake pad.

BRIEF DESCRIPTION OF THE DRAWINGS

FIG. 3 is an enlarged side view similar to FIG. 1 with the front wheel elevated and showing in phantom the front wheel biased against the brake pad in its neutral position where the skater is skating forward with no pressure on the front wheel;

FIG. 4 is a view similar to that of FIG. 2 but showing the brake partially disengaged when the skater skates forward with pressure on the front wheel;

DESCRIPTION OF THE PREFERRED EMBODIMENT(S)

The detailed description set forth below in connection with the appended drawings is intended as a description of a presently preferred embodiment of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequence may be accomplished by different embodiments that are also intended to be encompassed within the spirit and scope of the invention.

Figure 1:
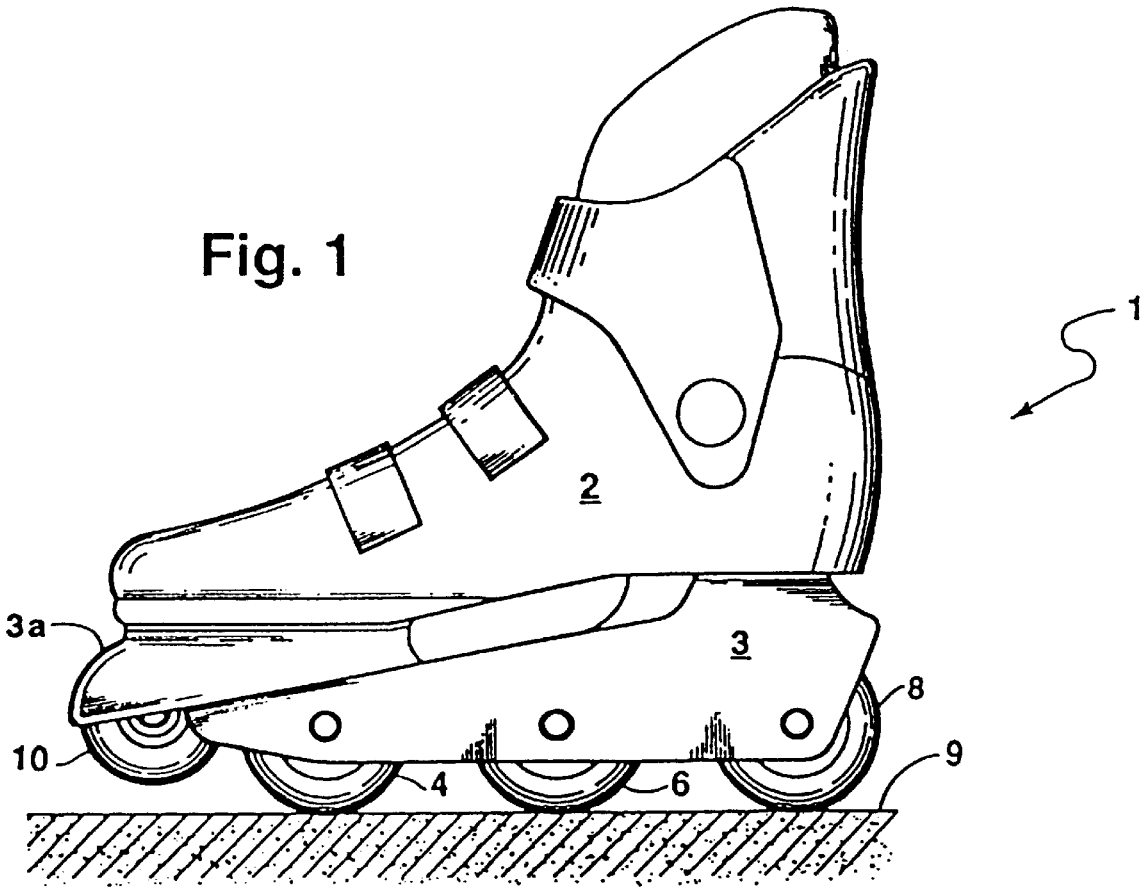
FIG. 1 is a side view of an in-line skate with an elevated front wheel in accordance with the invention.

With reference to FIG. 1, a skate such as an in-line skate 1 has a boot 2, a skate frame 3 and three regular wheels 4, 6 and 8 mounted to the frame as is well known in the art. All three of these wheels have the same radius and their centers lie along a common line, such that all three wheels will engage skating surface 9 at the same time. There is a fourth wheel referred to herein as a front wheel 10. Wheel 10 is elevated with respect to the other wheels such that when the other wheels engage the skating surface 9, wheel 10 is above the skating surface. To achieve this, wheel 10 may be smaller than the other wheels, or its axis may be above that of the other wheels, or a combination thereof.

Figure 2:
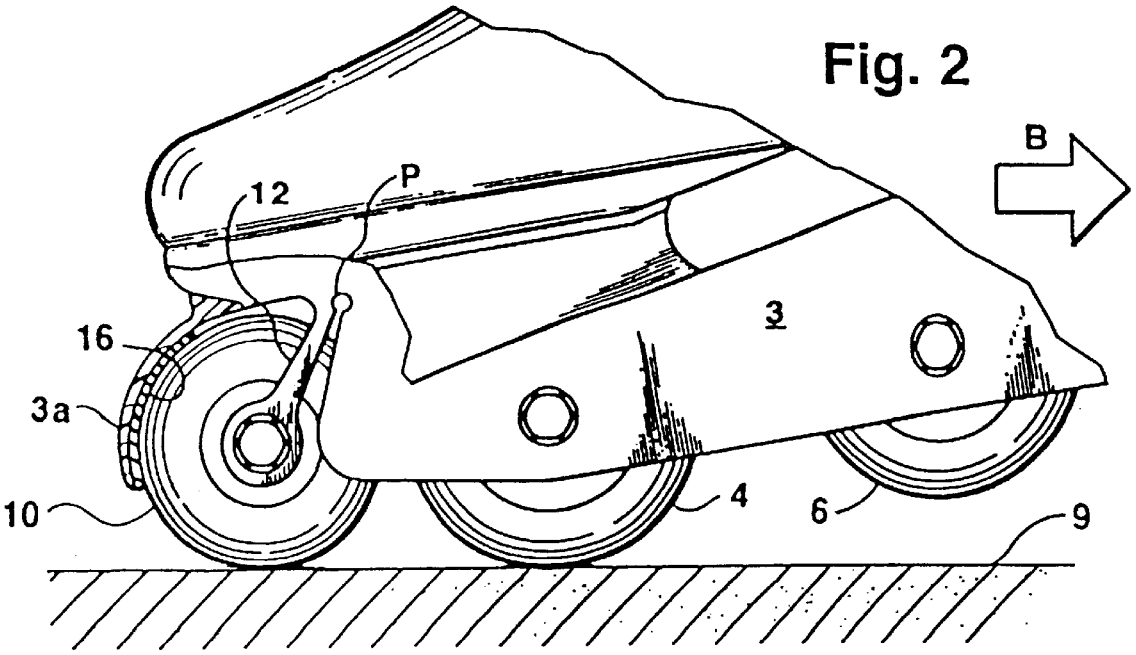
FIG. 2 is a broken away and enlarged side view of a portion of the skate of FIG. 1 showing the front wheel and a front wheel braking assembly, in accordance with the invention, with the brake engaged where the skater is skating rearward or pushing off in a rearward direction with pressure on the front wheel.
Figure 5:
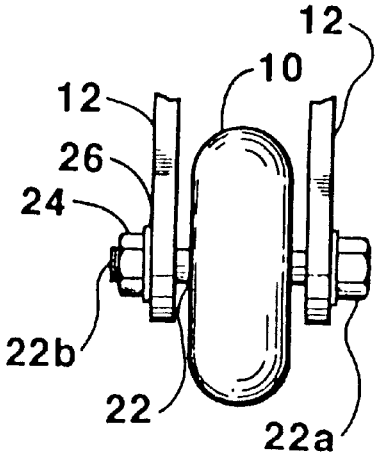
FIG. 5 is an enlarged front view of the front wheel and its mounting to the frame.

With reference to FIGS. 2, 3 and 5, front wheel 10 is mounted on two arms 12 integrally or unitarily formed with the frame 3. Frame 3 has a forward portion 3*a* inside which there is a brake pad 16. The arms 12 are formed so as to bias the wheel 10 forward against pad 16. The arms 12 support an axle 22 which passes through an aperture in the wheel. Axle 22 may be a bolt with a head 22*a* and a threaded end 22*b* having a nut 24 and a washer 26 thereon. Bearing structure may be in accordance with what is well known in the art.

With reference to FIGS. 1 through 4, operation of the safety brake will now be explained. When skating normally as in FIG. 1, in a forward or rearward direction, the front wheel 10 is elevated with respect to the skating surface 9. Therefore, the brake is disengaged even though the wheel 10 is biased against brake pad 16. In this embodiment, the arms 12 tend to bias the wheel to pivot clockwise around a pivot point P to bias the wheel forward. When a skater wants a push start, or wants to apply the brake to hold his/her ground, or as a brake when skating rearward, the skater rotates the skate so that the front wheel 10 engages the ground or skating surface 9. The second wheel 4 may also engage the ground. Skating rearward, or pushing rearward, provides a rearward thrust on front wheel 10. This rearward thrust causes a forward reaction force due to friction on the wheel from the skating surface, and the arms 12 pivot or tend to pivot clockwise, thus ensuring hard contact between the front wheel 10 and brake pad 16. The harder the skater pushes down and/or backward on wheel 10, the harder the braking force becomes.

FIG. 2 shows a skater skating or pushing backwards in direction B and applying the brake.

If, as shown in FIG. 4, the skater is skating in a forward direction F, and is pushed forward onto wheel 10 or accidentally rotates his or her foot to cause wheel 10 to engage the skating surface 9, the frictional force between wheel 10 and surface 9 reduces the contact force between wheel 10 and brake pad 16. This ensures that the brake is not inadvertently engaged when skating in a forward direction so as to avoid tripping the skater.

Figure 6:
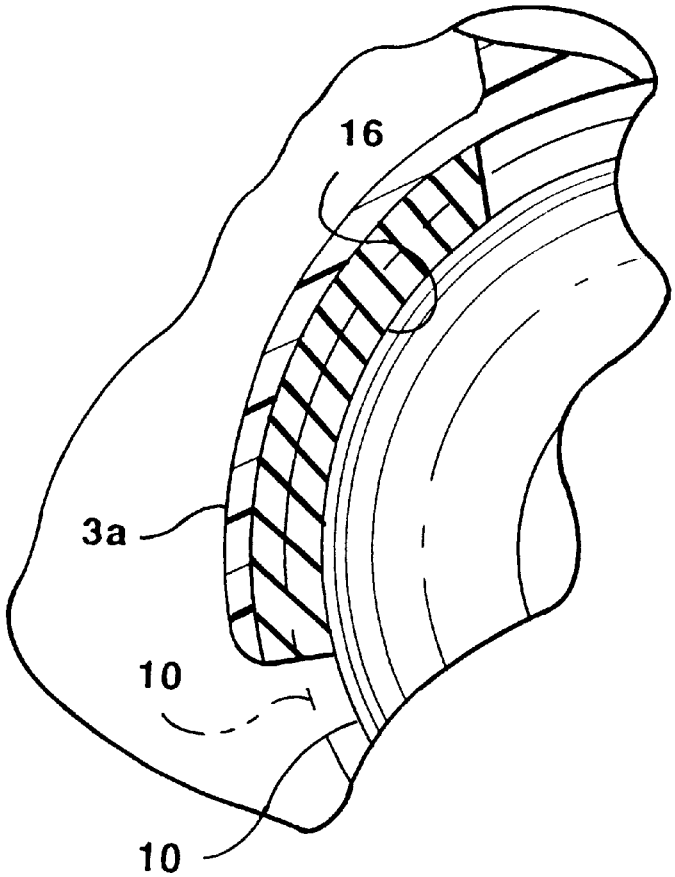
FIG. 6 is an enlarged sectional and partial view of the wheel and brake pad engagement of FIG. 2 in phantom and FIG. 4 in solid.

FIG. 6 shows the brake pad and wheel engagement positions of FIGS. 2 and 4. Engagement is enhanced as in FIG. 2 for backward skating or pushing due to the frictional force between the wheel and skating surface and wedge effect of the skater's weight on the angled arm 12. This is shown in phantom in FIG. 6.

Engagement is reduced in the solid portion of FIG. 6 which corresponds to FIG. 4, where the skater is skating forward, due to the effect of friction between the wheel and skating surface and thus minimizes or reduces the effect of a skater undesirably leaning forward when skating forward.

The position of FIG. 3 is the neutral position of the wheel and brake pad's engagement, where the wheel is elevated from the skating surface. This may be a free spinning position, but preferably there is still a slight braking force on the wheel. Thus, the neutral position may be between the positions of FIGS. 2 and 4, or less compressed than the position of FIG. 4, depending upon the user's weight and downward pressure in FIG. 4, and other factors including the characteristics of the arm 12, its angle, material, thickness and dimensions, and the skating surface.

With the construction in accordance with the invention, frictional force on the wheel from the brake increases if the wheel 10 touches the ground when the skater skates or pushes backward, and is decreased relative thereto if the wheel 10 touches the ground when the skater skates or pushes forward.

In other words, the forward sliding frictional force between the wheel 10 and skating surface increases the bias against the brake pad when skating backward, and the rearward sliding frictional force between the wheel 10 and skating surface reduces the bias against the brake pad when skating forward. Thus, the brake force when skating forward is self-reducing and when skating or pushing rearward it is self-energizing.

In normal operation, the bias on the wheel 10 against the brake pad preferably would be such that it would not be overcome by the force of sliding friction between the wheel 10 and the skating surface when skating forward. A bump or other obstacle, however, could create sufficient backward force on the wheel 10 to separate it temporarily from the brake pad.

The brake pad may be made preferably of a tough, smooth, nonabrasive material with a high coefficient of sliding friction surface, such as urethane. This material has good wear-resistance yet also provides a secure braking force in conjunction with typical in-line skate wheel material of urethane. Other materials which would serve as a braking pad would be evident to those of ordinary skill in the art.

While the illustrated embodiment shows a front wheel mounting mechanism of two parallel arms biased forward or clockwise, and unitarily or integrally formed with the skating frame, these arms could be mounted on a pivot rod located at point P and biased forward. In addition, the biasing force may be changed by varying the arm's thickness, angle, pivot point location, or other parameters that may be apparent to those of ordinary skill in the art. It may be advantageous to reinforce the arms 12, particularly in the area of the pivot point P to avoid breakage.

The principles of braking suggest that one should choose a brake pad material and the other brake parameters such that the wheel to brake frictional force make it easy for the skater to maintain a braking force which does not readily exceed the frictional force between the wheel and the skating surface to minimize the likelihood of skidding when applying the brake. In a preferred embodiment, the angle of the arm 12 may be 45°, greater than 45°, or less than 45° depending on the designed component or percentage of vertical thrust that is desired to be used to bias the wheel against the pad.

The invention provides activation and deactivation by the direction of thrust and the reaction force on the front wheel. Therefore, it provides a safe, foolproof braking system.

While the present invention has been described with regards to particular embodiments, it is recognized that additional variations of the present invention may be devised without departing from the inventive concept such as varying the number of wheels.

What is claimed is:

1. A roller skate with a braking device, the skate having a boot with a toe section at a front end of the skate and a heel section at a rear end of the skate and a frame attached thereto, the frame supporting a plurality of wheels of the skate, the wheels defining a single skating plane, the braking device comprising:

a front wheel located proximate the toe section of the skate;

a brake pad disposed in front of the front wheel and attached to the frame;

means for mounting the front wheel to the frame for normally biasing the front wheel forward against the brake pad, the means for mounting being responsive to a forward frictional force on the front wheel to increase the force of the wheel on the brake pad, and responsive to a rearward frictional force on the front wheel to reduce the force of the front wheel on the brake pad tending to disengage the brake, wherein the front wheel is elevated with respect to the skating plane, and thereby is elevated with respect to a skating surface corresponding to the skating plane, and whereby the brake will be activated when skating or pushing rearward and moving the skater's foot to cause the front wheel to engage the skating surface, the front wheel will be urged against the brake pad and provide a braking force on the front wheel, and when skating forward and moving the skater's foot to cause the front wheel to engage the skating surface, the front wheel will be urged away from the brake pad by a rearward frictional force between the front wheel and the skating surface so that the front wheel will rotate with very little friction.

2. The roller skate of claim 1 wherein the means for mounting comprises two arms pivotally and integrally attached to the skate frame.

3. The roller skate of claim 1 wherein the means for mounting comprises two arms pivotally attached to and unitarily formed with the skate frame.

4. A roller skate comprising:

a boot with a toe section at a front thereof and a heel section at a rear thereof;

a frame attached to the boot;

a plurality of wheels rotatably mounted to the frame and forming a single skating plane;

a front wheel located proximate the toe section of the skate;

a brake pad disposed in front of the front wheel and mounted on the skate frame;

means for mounting the front wheel to the frame for normally biasing the front wheel forward against the brake pad, the means for mounting being responsive to a rearward thrust on the skate to force the front wheel against the brake pad, and responsive to a rearward frictional force on the front wheel to reduce the force of the wheel on the brake pad tending to disengage the brake, wherein the front wheel is elevated with respect to the skating plane, and whereby the brake will be activated when skating or pushing rearward and moving the skater's foot to cause the front wheel to engage the skating plane and an adjacent wheel to engage the skating plane, the front wheel will be urged against the brake pad and provide a braking force on the front wheel, and when skating forward and moving the skater's foot to cause a front wheel to engage the skating plane and an adjacent wheel to engage the skating plane, the front wheel will be urged away from the brake pad so that the front wheel will rotate with very little friction.

5. The skate of claim 4 wherein the means for mounting comprises two arms pivotally attached to the skate frame.

6. The roller skate of claim 4 wherein the means for mounting comprises two arms pivotally attached to and unitarily formed with the skate frame.

7. The roller skate of claim 4 wherein the wheels and the front wheel are disposed in the same plane.

* * * * *